US006844307B1

(12) United States Patent
Sumner

(10) Patent No.: US 6,844,307 B1
(45) Date of Patent: Jan. 18, 2005

(54) COMPOSITIONS TO REDUCE TEXTILE CONTAMINANTS AND ASSOCIATED PROCESSING METHODS

(76) Inventor: Jeffrey Todd Sumner, 1770 E. Indiana Ave., Southern Pines, NC (US) 28387

( * ) Notice: Subject to any disclaimer, the term of this patent is extended or adjusted under 35 U.S.C. 154(b) by 241 days.

(21) Appl. No.: 10/067,109

(22) Filed: Feb. 4, 2002

(51) Int. Cl.[7] ..... C11D 3/44
(52) U.S. Cl. ..... 510/417; 510/363
(58) Field of Search ..... 510/407, 417, 510/276, 363

(56) References Cited

U.S. PATENT DOCUMENTS

| | | | | |
|---|---|---|---|---|
| 3,752,649 | A | | 8/1973 | Smerz et al. |
| 3,864,077 | A | | 2/1975 | Popp et al. |
| 3,970,698 | A | | 7/1976 | Lannert |
| 4,155,856 | A | | 5/1979 | Reinert et al. |
| 4,229,176 | A | | 10/1980 | Schafer et al. |
| 4,294,576 | A | | 10/1981 | Helfert et al. |
| 5,464,555 | A | * | 11/1995 | Bayless |
| 5,482,645 | A | | 1/1996 | Maruyama et al. |
| 6,191,087 | B1 | | 2/2001 | Opre et al. |
| 6,284,720 | B1 | * | 9/2001 | Opre |

FOREIGN PATENT DOCUMENTS

| | | | |
|---|---|---|---|
| JP | 55080575 | A | 6/1980 |
| WO | WO 01/47860 | A1 | 12/2000 |

* cited by examiner

*Primary Examiner*—Gregory Webb
(74) *Attorney, Agent, or Firm*—Alston & Bird LLP

(57) ABSTRACT

Contaminant solubilizing compositions are provided that are suitable for use in a variety of textile applications, including dyeing applications. The contaminant solubilizing compositions generally include at least one $C_1$ to $C_4$ ester of lactic acid, at least one surfactant and at least one solvent. The contaminant solubilizing compositions may be used either alone or within larger textile cleaning compositions to remove contaminants from the surfaces of textile articles or the manufacturing equipment used to process textile articles, including dyeing equipment.

21 Claims, No Drawings

COMPOSITIONS TO REDUCE TEXTILE CONTAMINANTS AND ASSOCIATED PROCESSING METHODS

FIELD OF THE INVENTION

The present invention generally relates to textile articles and the equipment used to produce such textile articles. More particularly, the present invention relates to compositions and associated methods to remove various contaminants from the surfaces of textile articles and textile processing equipment.

BACKGROUND OF THE INVENTION

The removal of contaminants from the surface of textile articles and textile processing equipment is a significant concern within the textile industry. The presence of surface contaminants is particularly troublesome within dyeing operations, especially within fabric dyeing processes. A wide range of surface contaminants may potentially be present within a given fabric dye cycle, including residual dyestuffs from either the present and/or previous dye cycles and/or oligomers.

Processes and compositions have been developed that attempt to reduce the amount of textile contaminants present during dyeing. For example, dye machine cleaning procedures, referred to in the art as "boil-outs," have evolved over time to reduce the build up of textile contaminants on the surfaces of dye machines. Boil-outs generally involve recirculating a cleaning composition through an otherwise empty dye machine. Boil-outs are typically conducted at an elevated temperature, for example a temperature of about 270° F., for an extended period of time, such as about 3 to 6 hours. Conventional boil-out procedures thus incur expense due to both the increased utility costs associated with heating the dye bath and the extended downtime involved.

Conventional boil-out compositions are typically highly alkaline, with exemplary compositions exhibiting pHs of up to 12. An exemplary conventional boil-out composition may include about 9 to about 10 weight percent caustic, about 2 to about 5 weight percent reducing chemical, and about 5 to about 20 weight percent solvents, based on the weight of the boil-out composition. Conventional boil-out compositions thus present possible environmental concerns due to their high alkalinity and use of solvents.

Boil-out procedures are generally designed to remove residual dyestuffs from the walls of the dye machine, and may be used with all types of textile dyes and dyeing equipment. It is important to remove any residual dyestuffs remaining after a dye cycle because it may adversely affect the shade and/or levelness of subsequent dyeings within the dye machine. The removal of residual dyestuffs from a dye machine is of particular importance when changing from the dyeing of dark shades to light shades within a dye machine. However, in addition to reducing the amount of residual dyestuffs, boil-out processes may also be intended to remove other contaminants, depending on the type of fabric being dyed. For example, boil-out procedures performed in conjunction with the dyeing of polyester fabrics are generally intended to remove both oligomeric deposits and residual dyestuffs from the surfaces of the dye machine.

Polyester fibers inherently contain oligomers, or small molecule polymers, as a by-product. Trimer is the predominate oligomeric species within polyester fiber formed from polyethylene terephthalate. Trimer tends to bloom to the surface of the polyester fiber as it is being processed at elevated temperatures. Thus trimer generally rises to the surface of polyester fibers during dyeing, particularly under the high temperature conditions commonly utilized during the disperse dyeing of polyester fibers. In addition to migrating to the surface of the polyester fiber, a significant portion of the migrating trimer also typically enters the dye bath during dyeing.

Trimer within the dye bath is particularly problematic because it forms deposits on the surface of the fabric or yarn being dyed, as well as on the walls of the dye machine. Such trimer deposits on fabric or yarn surfaces do not dye evenly and remain as visible crystals after dyeing, yielding off quality goods. Trimer deposits on the polyester fiber also increases the frictional resistance of the resulting fabrics or yarns, ultimately leading to filament breaks during textile processing. Trimer deposits on polyester fabric or yarn also form a powder or dust on guide devices as the fabric or yarns travel over the devices, further exacerbating frictional resistance and quality issues. Trimer deposits on the walls of the dye machine can negatively impact the quality of dyed goods processed within the machine because such deposits may precipitate upon the surface of the dyed goods as they are being cooled at the end of the dye cycle. Thus trimer deposits lead to millions of dollars annually in waste and rework.

Processes and compositions have been developed that attempt to address the trimer issues associated with polyester goods. For example, alkaline solutions used to reduce trimer are discussed in U.S. Pat. No. 4,294,576. However, such alkaline solutions are not generally effective in removing trimer. Similarly, aromatic carboxylic acids in conjunction with halogenated hydrocarbons, polyethylene/polypropylene oxide block copolymer, and alkylene oxide adducts are known for treating polyester fiber, as described in U.S. Pat. No. 4,155,856. Phthalic ester compositions have also been developed to treat the polyester fabric, either during or after dyeing, as discussed in U.S. Pat. No. 4,229,176. However, such phthalic ester compositions adversely affect soilability, especially in reference to dry dirt.

Thus there remains in the art a need for compositions that are capable of effectively removing trimer from the surface of polyester fiber without significant detriment to the remaining fiber properties. There is also a need in the art for a composition capable of holding trimer in suspension in the dye bath until it can be flushed from the machine, rather than forming unwanted deposits. There further remains a need in the art for a composition and process for use in removing trimer and other textile contaminants from the walls of dyeing equipment which may employed at comparatively low temperatures for a comparatively short amount of time.

BRIEF SUMMARY OF THE INVENTION

The present invention provides compositions that are capable of removing trimer from the surface of polyester fiber without significant detriment to the remaining fiber properties. The present compositions further hold trimer that migrated from the fiber surface in suspension in the dye bath until it can be flushed from the machine. The instant compositions and processes may also be employed to remove a range of textile contaminants, including trimer deposits and/or residual dyestuffs, from the walls of dyeing equipment at comparatively low temperatures in a comparatively short amount of time in comparison to conventional boil-out procedures.

The present invention generally provides a contaminant solubilizing composition that includes at least one $C_1$ to $C_4$ ester of lactic acid; at least one surfactant; and at least one solvent. Exemplary $C_1$ to $C_4$ alcohols from which the $C_1$ to $C_4$ ester of lactic acid is derived include methanol, ethanol, propanol, isopropanol, allyl alcohol, butanol, 3-buten-1-ol, t-butanol and sec-butanol and mixtures thereof. In one beneficial embodiment, the $C_1$ to $C_4$ ester of lactic acid is ethyl lactate.

Exemplary surfactants for use in the contaminant solubilizing composition include isotridecyl alcohol tri-ethoxylate, polyethylene glycol ether of mixed synthetic $C_9$–$C_{11}$ fatty alcohols having an average of 6 moles of ethoxylate, polyethylene glycol ether of mixed synthetic $C_{11}$–$C_{15}$ is fatty alcohols having an average of 59 moles of ethoxylate, polyethylene glycol (6) nonylphenyl ether, polyethylene glycol (9) nonylphenyl ether, modified alkanolamide alkanolamine, phenol alkoxylates and mixtures thereof.

Suitable solvents for use in the contaminant solubilizing composition include water, ethanol, methanol, isopropanol and mixtures thereof. In advantageous embodiments, water may beneficially be employed as the solvent.

In further advantageous embodiments, the contaminant solubilizing composition further includes at least one oil scavenger. Exemplary oil scavengers include phosphated ethoxylate blends, stearic acid diethanolamide, sulphated and sulphited natural oils, sulphated and sulphited synthetic oils, polyethylene emulsions, polyethylene glycol esters, ethoxylated lanolin derivatives, fatty acid alylolamides, and mixtures thereof.

The various components within the contaminant solubilizing composition are generally present in amounts ranging from about 1 to about 90 weight percent $C_1$ to $C_4$ ester of lactic acid; about 1 to about 30 weight percent surfactant; from about 0.0 to about 30 weight percent oil scavenger; and up to about 98 weight percent solvent.

The present invention also provides textile cleaning compositions that include the contaminant solubilizing composition of the present invention in an amount sufficient to solubilize at least a portion of the contaminants located either on the surface of textile processing equipment or at or near the surface of polyester fiber; at least one alkaline compound in an amount sufficient to provide a pH of about 9.0 to about 10.0; and at least one reducing chemical in an amount sufficient to solubilize at least a portion of any residual dyestuffs present on the surface of textile processing equipment or at or near the surface of polyester fiber. In one advantageous embodiment, the contaminant solubilizing composition is present in an amount of about 4 weight percent within the textile cleaning composition. In an alternative embodiment, the contaminant solubilizing composition is present in an amount of about 2 weight percent within the contaminant solubilizing composition.

The present invention further relates to methods of solubilizing contaminants from the surfaces of textile dye machines or polyester fibers, as well as methods of dyeing and scouring textile articles. The instant invention also provides non-destructive methods for removing contaminants from the surface of textile articles or the manufacturing equipment used to produce such textile articles.

DETAILED DESCRIPTION OF THE INVENTION

The present invention now will be described more fully hereinafter. In many cases, preferred embodiments of the invention are described. This invention may, however, be embodied in many different forms and should not be construed as limited to the embodiments set forth herein; rather, these embodiments are provided so that this disclosure will be thorough and complete, and will fully convey the scope of the invention to those skilled in the art.

For purposes of clarity and illustration only, the compositions of the present invention will generally be described as a contaminant remover, particularly a residual dye and trimer remover, for use with textile dyeing equipment and polyester articles. However, it should be understood that compositions of the present invention are also believed to effectively remove contaminants other than residual dyes and trimer. Further, the compositions of the present invention are believed to remove oligomeric contaminants other than trimer, and the terms "trimer" and "oligomer" are used interchangeably hereinafter. Further, the contaminant solubilizing compositions of the instant invention may be useful with a variety of polymers that containing oligomeric byproducts other than polyester, such as nylon and the like. The contaminant solubilizing compositions of the present invention are also believed to be effective with polymeric materials in any form, including fibers, yarns, fabrics, films and the like. The contaminant solubilizing compositions of the present invention may also be beneficially employed with any textile fiber known in the art, including polyester, cotton, nylon, polyolefins and the like. In addition, the instant contaminant solubilizing compositions may further be used with polymeric and textile processing equipment other than dyeing equipment.

The instant contaminant solubilizing composition generally comprises an ester acid composition that includes at least one $C_1$ to $C_4$ ester of lactic acid, at least one surfactant, at least one solvent and, optionally, at least one oil scavenger. The contaminant solubilizing composition may be directly applied to the surface of a polyester article or dye equipment or may be included in further textile cleaning compositions, such as dye machine cleaning compositions and reduction clearing compositions.

As noted above, the contaminant solubilizing composition incorporates an ester acid composition that includes at least one $C_1$ to $C_4$ ester of lactic acid. As known in the art, lactic acid esters are generally formed by the reaction of lactic acid with an alcohol. Any alcohol capable of providing contaminant solubilizing capability to the lactic acid ester may be employed. Exemplary $C_1$ to $C_4$ lactic acid esters may be derived from alcohols that include methanol, ethanol, propanol, isopropanol, allyl alcohol, butanol, 3-buten-1-ol, t-butanol, sec-butanol and mixtures thereof. In one beneficial embodiment, the $C_1$ to $C_4$ ester of lactic acid is ethyl lactate (CAS No. 9764-3), which is derived from ethanol. Ethyl lactate is the ester of natural (L+) lactic acid produced by the fermentation of carbohydrate feedstock, such as corn. One suitable ethyl lactate which may be employed within the contaminant solubilizing composition is VERTEC ELS® available from Vertec BioSolvents, LLC of Mt. Prospect, Ill.

The $C_1$ to $C_4$ ester of lactic acid can be included in the contaminant solubilizing composition in any amount sufficient to solubilize at least a portion of the contaminants deposited either on the walls of the dye equipment or at or near the surface of the polyester fiber. As used herein, the phrase "contaminants deposited . . . at or near the surface of the polyester fiber" includes contaminants migrating out from inside the fiber, such as trimer, and contaminants deposited on the fiber surface from the outside, such as residual dyestuffs. For example, the $C_1$ to $C_4$ ester of lactic acid can be present in the contaminant solubilizing composition in an amount ranging from about 1 to about 90 weight percent, more specifically from about 20 to about 60 weight percent, based on the weight of the contaminant solubilizing composition. In one beneficial embodiment, the $C_1$ to $C_4$ ester of lactic acid is present in an amount of about 42 weight percent, based on the weight of the contaminant solubilizing composition.

The contaminant solubilizing composition further includes at least one surfactant. Any suitable non-ionic or anionic surfactant may be beneficially employed within the contaminant solubilizing composition. Exemplary non-ionic surfactants include isotridecyl alcohol tri-ethoxylate (Surfonic.RTM. TDA-3B, Huntsman Corp.), polyethylene glycol ether of mixed synthetic $C_9$–$C_{11}$ fatty alcohols having an average of 6 moles of ethoxalate (Neodol.RTM. 91.6), polyethylene glycol ether of mixed synthetic $C_{11}$–$C_{15}$ fatty alcohols having an average of 59 moles of ethoxalate (Tergitol.RTM. 15-S-59), polyethylene glycol (6) nonylphenyl ether (Tergitol.RTM. NP-6), polyethylene glycol (9) nonylphenyl ether (Tergitol.RTM. NP-9), modified alkanolamide alkanolamine (Monamine.RTM. 1255), phenol alkoxylates and mixtures thereof. Beneficially, the surfactant is a branched or linear alcohol ethoxylate. In advantageous aspects, the surfactant advantageously contains at least one $C_{10}$ to $C_{16}$ ethoxylated alcohol. Particularly beneficial $C_{10}$ to $C_{16}$ ethoxylated alcohols include ethoxylated lauryl alcohol; decyl alcohol ethoxylate, POE-4, commercially available as MAKON DA-4™ from the Stepan Company; and decyl alcohol ethoxylate, POE-6, commercially available as MAKON DA-6™ from the Stepan Company. Suitable phenol alkoxylates include nonyl and octyl phenol alkoxylates, such as the EMPILAN® NP and OP series, the SURFONIC® N and OP series, and the TERIC® N series, all available from Huntsman Corporation. In one particularly beneficial embodiment, the surfactant is a $C_{12}$ ethoxylated alcohol. The $C_{12}$ ethoxylated alcohol may advantageously be lauryl alcohol 4 moles, also referred to as LA-4. Lauryl alcohol 4 moles may be purchased from a number of suppliers, including Clariant Corporation.

The surfactant can be included in the contaminant solubilizing composition in any amount sufficient to emulsify at least a portion of the surface contaminants. For example, the surfactant can be present in the contaminant solubilizing composition in an amount ranging from about 1.0 to about 30.0 weight percent, and more specifically from about 10.0 to about 20.0 weight percent, based on the weight of the contaminant solubilizing composition. In one beneficial embodiment, the surfactant is present in an amount of about 15.0 weight percent, based on the weight of the contaminant solubilizing composition.

The contaminant solubilizing composition may optionally include at least one oil scavenger. The oil scavenger may be any oil scavenger or lubricant suitable for use in textile dyeing applications. In advantageous embodiments, the oil scavenger is advantageously anionic or non-ionic in order to be compatible with the disperse dyes typically used to dye polyester fiber and fabrics. Examples of suitable oil scavengers include: phosphated phenol ethoxylate, phosphated castor oil ethoxylate, stearic acid diethanolamide, sulphated and sulphited oils, both of natural and synthetic origin, polyethylene emulsions, polyethylene glycol esters, ethoxylated lanolin derivatives, fatty acid alylolamides, and mixtures thereof. In one beneficial embodiment, the oil scavenger is formed from a phosphated ethoxylate blend of phosphated phenol ethoxylate and phosphated castor oil ethoxylate. In one aspect of this embodiment, the phosphated ethoxylate blend has a ratio of about 20 parts phosphated phenol ethoxylate to about 80 parts phosphated castor oil ethoxylate. One advantageous oil scavenger for use in the present invention is LUBE ACA™, available commercially from Clariant Corporation.

The oil scavenger can be included in an amount sufficient to strip at least a portion of any oily contaminants present on the walls of the dye machine or at or near the surface of the fiber. For example, the oil scavenger can be present in the contaminant solubilizing composition in an amount of up to about 30 weight percent, more specifically from about 10 to about 20 weight percent, based on the weight of the contaminant solubilizing composition. In one beneficial embodiment, the oil scavenger is present in an amount of about 15 weight percent, based on the weight of the contaminant solubilizing composition.

The solvent may be any suitable liquid that is not incompatible with the remaining components within the contaminant solubilizing composition. Advantageous solvents do not present an environmental hazard. More specifically, advantageous solvents do not contain hazardous air pollutants, carcinogens, and the like. Exemplary solvents include water and lower molecular weight alcohols such as ethanol, methanol, isopropanol, and the like. The solvent may further be used in conjunction with minor amounts of one or more co-solvents. Suitable co-solvents are generally biodegradable and typically include higher molecular weight alcohols, esters, alkylene carbonates and ethers. In one beneficial embodiment water is employed as the solvent, either alone or in combination with co-solvents.

The solvent can be included in an amount sufficient to provide a suitable viscosity and/or concentration to the contaminant solubilizing composition. For example, the solvent can be present in the contaminant solubilizing composition in an amount of up to about 97 or about 98 weight percent, more specifically from about 10 to about 50 weight percent, based on the weight of the contaminant solubilizing composition. In one beneficial embodiment, the solvent is present in an amount of about 28 weight percent, based on the weight of the contaminant solubilizing composition.

The contaminant solubilizing composition is prepared by initially introducing the surfactant into a mixing kettle and initiating agitation. The ester acid composition is then added to the surfactant slowly over time, optionally followed by the oil scavenger. After the intermediate mixture becomes homogeneous, the solvent is added. Agitation is continued briefly after the solvent addition, such as for a time period of about 5 minutes. The pH of the mixture is then determined and adjusted to a pH ranging from about 6.0 to about 8.0, if necessary. In further advantageous embodiments, the pH of the contaminant solubilizing composition ranges from about 6.0 to about 7.0. The contaminant solubilizing composition may then be drummed or packaged as required. In an alternative embodiment, the contaminant solubilizing composition may be pumped directly to the appropriate textile processing equipment.

The surface of any textile processing equipment known in the art may be treated using the contaminant solubilizing composition of the present invention. More specifically, the contaminant solubilizing compositions of the present invention may advantageously be used to clean any textile dyeing equipment available in the art, including high temperature/high pressure dye machines and atmospheric dye machines. Exemplary dyeing equipment that may be cleaned using the contaminant solubilizing compositions of the present invention includes all types of conventional batch or continuous dyeing machines, such as cheese, package or beam dyeing machines, jet machines, becks, paddles, jiggers or rotary type dye machines, all configurations of pad dyeing equipment, continuous dye ranges, and washing machines. In advantageous aspects, the contaminant solubilizing composition may be used in combination with polyester dyeing equipment intended for disperse dyeing under high temperature conditions, such as jet machines. The contaminant solubilizing compositions of the present invention may further be used to remove any known type of residual dye from the surfaces of dye machines and/or fibers, including vat dyes, sulphur dyes, acid dyes, direct dyes, reactive dyes, and disperse dyes. The contaminant solubilizing compositions of the present invention may further be used to remove pigments.

In addition to is use in removing residual dyes and pigments from textile equipment and fibers, the contaminant solubilizing composition may also be employed to remove trimer from the surface of any polyester article. Suitable polyester articles may generally be formed from linear high molecular weight polyesters produced by the polycondensation of polycarboxylic acids with polyfunctional alcohols. Exemplary polyesters include polymers derived from terephthalic acid or dimethylol cyclohexane or copolymers of terephthalic acid and isophthalic acid with ethylene glycol. Advantageously, the polyester is polyethylene terephthalate. In beneficial embodiments, the polyester article is a textile article, such as a polyester fiber. The polyester fiber may be provided in any form, including continuous filament and staple fiber. The polyester fiber may also be incorporated into further textile articles, such as yarns, threads, fabrics and the like. The polyester fiber may be processed into any fabric construction known in the art, such as knitted fabric, woven fabric, nonwoven fabric, flocked fabric, scrims and the like. The polyester fibers may further be used alone or may be present in blends with one or more other fibers, such as, but not limited to, polyester/cotton, polyester/polyamide, polyester/polyacrylonitrile, polyester/rayon and polyester/wool blends. It is further contemplated that the contaminant solubilizing composition may be beneficially employed to remove trimer from the surface of polyester film. In advantageous embodiments, the contaminant solubilizing composition is used to treat polyester fiber present in knit or woven fabric.

The contaminant solubilizing composition may be applied to the polyester articles or textile processing equipment either directly, i.e. either alone or diluted with water, or within larger textile cleaning compositions. Exemplary textile cleaning compositions include dye machine cleaning compositions and reduction clearing compositions.

More specifically, the present contaminant solubilizing compositions may be applied either alone or in combination with conventional dye machine cleaning chemicals, such as the chemicals used during boil-outs and the like. Exemplary dye machine cleaning compositions formed in accordance with the present invention generally include the contaminant solubilizing composition, at least one reducing chemical, at least one alkaline compound, and water. Any conventional reducing chemicals and alkaline compounds known in the art of dyeing for use in conjunction with the particular residual dyestuffs and/or contaminants may be employed. For example, suitable reducing chemicals for use in conjunction with the disperse dyeing of polyester based textile articles include sodium hydrosulfite, thiourea dioxide and mixtures thereof. Advantageous alkaline compounds include sodium hydroxide and the like.

The contaminant solubilizing composition is generally included in the dye machine cleaning composition in an amount sufficient to solubilize at least a portion of the contaminants present on the dye machine surfaces. For example, the contaminant solubilizing composition may be included in the dye machine cleaning composition in an amount ranging from about 1.0 to about 4.0 weight percent, beneficially from about 1.5 to about 2.5 weight percent, based on the weight of the textile cleaning composition. In one beneficial embodiment, the contaminant solubilizing composition is present within the dye machine cleaning composition in an amount of about 2.0 weight percent, based on the weight of the dye machine cleaning composition. The reducing chemical may be included in the dye machine cleaning composition in any suitable amount known in the art to remove the particular residual dyestuff from the surfaces of textile dye machines. Exemplary amounts of the reducing chemical within dye machine cleaning compositions typically range from about 0.5 to about 1.0 weight percent based on the weight of the dye machine cleaning composition. Exemplary amounts of the alkaline compound within dye machine cleaning compositions typically range from about 0.5 to about 1.0 weight percent of a 50% caustic solution, based on the weight of the dye machine cleaning composition. Generally, a sufficient quantity of at least one alkaline compound is present within dye machine cleaning compositions to provide a pH of at least about 9.0, advantageously about 9.0 to about 10.0.

The dye machine cleaning composition may readily be formed within the dye machine. The dye machine cleaning composition is prepared by at least partially filling the dye machine with water, introducing the contaminant solubilizing composition into the dye machine, adjusting the diluted contaminant solubilizing composition to a pH of at least about 9.0 and adding at least one reducing chemical. In beneficial embodiments, the pH of the diluted contaminant solubilizing composition ranges from about 9.0 to about 10.0. The dye machine cleaning composition may then be used to clean the interior surfaces of the dye machine by heating the dye machine cleaning composition to a temperature of up to about 270° F. and circulating the dye machine cleaning composition within the dye machine for a time sufficient to remove at least a portion of the contaminants from the surface of the dye machine. In advantageous embodiments, the dye machine cleaning composition may be heated to a temperature ranging from about 130 to about 140° F. In further advantageous embodiments, the dye machine cleaning composition may be recirculated within the dye machine for a time of about 15 minutes. Following circulation, the dye machine cleaning composition may be drained from the dye bath prior to loading the dye machine with the textile articles.

As noted earlier, conventional boil-out procedures require the use of much higher temperatures, for example boil-out temperatures of about 270° F. are common. In contrast, the dye machine cleaning compositions of the present invention may advantageously be employed at much lower temperatures, such as temperatures ranging from about 130 to about 140° F. Further, conventional dye bath cleaning procedures are normally conducted for extended time periods. Boil-outs that last up to 6 hours are not uncommon. In comparison, the instant dye machine cleaning composition may advantageously be recirculated within the dye bath for about 15 minutes. Consequently, the present invention allows dye machines to be cleaned both at much lower temperatures for a significantly shorter period of time. The use of lower temperature cleaning procedures reduces the utility costs incurred by the dyehouse. Shorter cleaning times mean less down time for the dye machine, resulting in productivity gains. In fact, it is believed that the contaminant solubilizing compositions of the present invention can be used to reduce dyehouse downtime due to boil-outs by about 90% or more.

In alternative embodiments, the contaminant solubilizing compositions may also be included in textile cleaning compositions used to remove trimer and excess dyestuffs from the surface of dyed polyester fibers, such as in reduction clearing compositions. Advantageously, boil-outs between dye cycles may be avoided by using reduction clearing compositions formed in accordance with the present invention. Exemplary reduction clearing compositions in accordance with the present invention generally include the contaminant solubilizing composition and at least one reducing chemical. Reduction clearing compositions also typically include at least one alkaline compound. Reduction clearing compositions generally utilize the reducing chemicals and alkaline compounds noted for use in the dye machine cleaning compositions described above. For example, suitable reducing chemicals generally include sodium hydrosulfite and thiourea dioxide. Advantageous alkaline compounds include sodium hydroxide and the like.

The contaminant solubilizing composition is generally included in the reduction clearing composition in an amount sufficient to solubilize at least a portion of the contaminants present on or near the surface of the dyed polyester fiber. For example, the contaminant solubilizing composition may be included in the reduction clearing composition in an amount ranging from about 1.0 to about 8.0 weight percent, advantageously from about 2.0 to about 6.0 weight percent, based on the weight of the reduction clearing composition. In one advantageous embodiment, the contaminant solubilizing composition may be included in the reduction clearing composition in an 4, amount of about 4 weight percent, based on the weight of the reduction clearing composition. The recommended amounts of reducing chemicals and alkaline compounds for inclusion in reduction clearing compositions formed in accordance with the present invention are those amounts known in the art for reduction clearing compositions used in conjunction with polyester based textiles. An exemplary amount of the reducing chemical within reduction clearing compositions according to the present invention is about 2.0 weight percent, based on the weight of the reduction clearing composition. An exemplary amount of the alkaline compound within reduction clearing compositions in accordance with the present invention is about 2.0 weight percent, based on the weight of the reduction clearing composition.

The reduction clearing composition may similarly readily be formed within the dye machine. Specifically, the reduction clearing composition may be formed within the dye machine by introducing the contaminant solubilizing composition into a dye machine that is at least partially filled with either water or spent dye solution and adding at least one reducing chemical. The pH of the reduction clearing composition may then be adjusted to a pH at least about 9.0, beneficially between about 9.0 and about 10.0, by adding at least one alkaline compound. The reduction clearing composition may be advantageously heated to a temperature sufficient to promote the solubilization of at least a portion of the contaminants present on or near the surface of the polyester fiber. In beneficial embodiments, the reduction clearing composition is heated to a temperature ranging from about 140 to about 180° F., advantageously from about 160° F. to about 180° F. The heated reduction clearing composition is circulated within the dye machine for a dwell time sufficient to promote the solubilization of at least a portion of the contaminants present on or near the surface of the polyester fiber, such as a dwell time of about 15 minutes. Following circulation, the dye machine may be drained, the reduction cleared textile articles rinsed with fresh water and the textile articles unloaded from the dye machine.

The contaminant solubilizing and textile cleaning compositions of the present invention have no known adverse impact the dyeing process itself. For example, conventional liquor ratios and dyeing conditions known in the art for conventional polyester dyeings, particularly polyester dyeings performed with disperse dyes, may be employed. Further, the chemicals used in the dyeing process are not adversely impacted by the compositions of the present invention. For example, conventional disperse dyes, dye carriers, dye levelers and the like may be utilized in conjunction with the present invention.

In fact, in advantageous embodiments, the contaminant solubilizing composition may be utilized multiple times within a given dye cycle to produce highly beneficial results in the productivity and quality produced by the dye cycle as a whole. As used herein, a dye cycle includes the process steps of dye machine cleaning, dyeing, and optional reduction clearing of the dyed fabric. For example, in one aspect of the invention, the contaminant solubilizing composition is used within a single dye cycle both during the dye machine cleaning step and the reduction clearing step.

More specifically, in one aspect of the invention a dye cycle is provided within a jet dyeing machine in which a dye machine cleaning composition incorporating the contaminant solubilizing composition is prepared using the chemicals, amounts and procedures described above within the dye machine prior to initiating dyeing. As further discussed above, the temperature of the dye machine cleaning composition may be elevated to up to about 270° F., and is beneficially elevated to a temperature ranging from about 130 to about 140° F. The heated dye machine cleaning composition is then circulated within the dye machine for a suitable amount of time to remove at least a portion of the contaminants from the surface of the dye machine, such as a circulation time of approximately 15 minutes. Following circulation, the dye machine cleaning composition may then be drained from the dye machine. The drained dye machine is subsequently refilled at least partially with fresh water.

Following the dye machine cleaning step, a defoaming composition is formed within the dye machine by introducing at least one defoamer and at least one acidic compound into the fresh water. The defoamer may be any conventional defoamer known in the art of polyester dyeing. More specifically, suitable defoamers include both silicone and non-silicone defoamers. The acidic compound may similarly be any conventional acidic compound known for use in the art of polyester dyeing. In advantageous embodiments, the acidic compound is acetic acid.

The defoaming composition may contain any suitable amounts of defoamer and acidic compound known in the art for use in such compositions. In beneficial embodiments, the defoamer is present in the defoaming composition in an amount of about 0.25 weight percent, based on the weight of the defoaming composition. The acidic compound may be included in the defoaming composition in an exemplary amount of about 0.25 weight percent, based on the weight of the defoaming composition.

The defoaming composition may optionally be recirculated within the dye machine for a suitable amount of time, such as for a time of about 2 minutes. Following recirculation, the defoaming composition is drained from the dye machine. The emptied dye machine is then at least partially refilled with fresh water and the dye machine loaded with suitable textile articles, such as polyester fabric and the like. The textile articles are then dyed using conventional chemicals and procedures known in the art. For example, in one advantageous embodiment the textile articles are dyed using disperse dyes. In a further aspect of the invention, the textile articles are dyed under pressure at a temperature ranging from about 265 to about 270° F. Following the dyeing step, the dye machine is allowed to depressurize and cool. In one beneficial embodiment, the dye machine is cooled to a temperature ranging from about 140° F. to about 180° F., advantageously from about 160° F. to about 180° F., following dyeing.

A reduction clearing composition incorporating the contaminant solubilizing composition may then be formed in the cooled dye machine. The reduction clearing composition incorporating the contaminant solubilizing composition may be prepared using the chemicals, amounts and procedures described above. As further discussed above, the reduction clearing composition may be recirculated within the dye machine at a temperature ranging between about 140 to about 180° F., advantageously from about 160° F. to about 180° F., for a dwell time sufficient to remove at least a portion of the contaminants at or near the surface of the textile article, such as a dwell time of about 15 minutes. Following recirculation, the reduction clearing composition may be drained from the dye machine and the textile articles rinsed to remove any residual reduction clearing composition. The textile articles may then be unloaded following rinsing.

A comparable dye cycle incorporating the contaminant solubilizing compositions of the present invention may be used in combination with package dyeing equipment. The compositions, process conditions and dwell times used in the various dye cycle stages of the jet dyeing cycle described above may also generally be used within a package dyeing cycle. However, in advantageous aspects, the defoaming composition used in combination with the package dyeing cycle may advantageously contain about 0.5 weight percent defoamer and about 0.5 weight percent acidic compound, based on the weight of the defoamer composition. In one advantageous embodiment, the package dye machine is drained following the dyeing step and refilled with fresh water. The fresh water is then heated, for example to a temperature ranging between about 140 to about 160° F., and used to form the reduction clearing composition.

In alternative embodiments, the contaminant solubilizing composition may be applied to the textile articles prior to the dye cycle, such as during a scouring process or the like. As used herein, the term "scouring," whether used in reference to either processes or compositions, encompasses both "scouring" and "desizing." Scouring processes are generally employed to remove finishing oils, waxes, sizing and the like from the surface of fabrics prior to dyeing. The contaminant solubilizing composition may be added to any conventional scouring compositions known in the art. One exemplary conventional scouring composition includes anionic surfactant and soda ash at a concentration of about 2 grams per liter in warm water. In an alternative advantageous embodiment, scouring compositions in accordance with the present invention may be formed from the instant contaminant solubilizing composition, a foaming agent and water. The contaminant solubilizing composition may be included in the scouring compositions in an effective amount to solubilize at least a portion of the contaminants present at or near the surface of the fabric. Any foaming agent known in the art for use in textile scouring applications may be employed. The foaming agent and water may be included in conventional amounts typically employed in textile scouring compositions.

The equipment used to scour fabrics is typically referred to as either a scouring range or preparation range. Scouring ranges generally include a series of scouring and/or rinsing baths followed by a dryer. In beneficial embodiments, the instant scouring composition may be formed within at least one of the scouring baths within a scouring range by at least partially filling the scouring bath with water and introducing an effective amount of a contaminant solubilizing composition formed in accordance with the present invention to form an intermediate composition. An effective amount of at least one foaming agent may also added to complete the scouring composition, either to the intermediate composition or the water originally introduced into the scouring bath.

In addition to the embodiments provided above, the contaminant solubilizing composition may be used to remove contaminants from the surface of polyester articles in an off-line process. Such off-line aspects of the invention generally involve applying an effective amount of the contaminant solubilizing composition to the surface of the polyester article; treating the surface of the polyester article with the contaminant solubilizing composition for an effective amount of time; and rinsing the contaminant solubilizing composition from the surface of the polyester article. Such off-line aspects of the invention may be used to treat polyester articles such as polyester fiber, yarn, fabric or film. The off-line aspects of the present invention may further be used to treat the polyester articles either prior to or following dyeing. In addition to its direct use on polyester articles, the contaminant solubilizing compositions of the present invention may also be applied directly to either the exterior or interior surfaces of textile processing equipment to remove any contaminants present thereon.

The contaminant solubilizing compositions of the present invention thus provide a wide range of effective compositions and efficient methods by which to remove contaminants both from the surfaces of textile processing equipment, such as dye machines, and from polyester articles, including fibers and fabrics. In addition, the present contaminant solubilizing and textile cleaning compositions are environmentally friendly and contain no HAPs or ozone depleting materials. The present compositions are all safe, non-toxic, non-carcinogenic materials that rinse free with water. As an added benefit, the present compositions are biodegradable and made from renewable resources.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A contaminant solubilizing composition comprising:

(a) about 1 to about 90 weight percent, based on the weight of the contaminant solubilizing composition, of an ester acid composition consisting essentially of at least one $C_1$ to $C_4$ ester of lactic acid;

(b) about 1 to about 30 weight percent, based on the weight of the contaminant solubilizing composition of at least one surfactant;

(c) up to about 98 weight percent, based on the weight of the contaminant solubilizing composition, of at least one solvent selected from the group consisting of water, methanol, ethanol, and isopropanol; and at least one oil scavenger selected from the group consisting of phosphated ethoxylate blend, stearic acid diethanolamide, sulphated and sulphited natural oils, sulphated and sulphited synthetic oils, polyethylene emulsions, polyethylene glycol esters, ethoxylated lanolin derivatives, fatty acid alyolamides, and mixtures thereof.

2. A contaminant solubilizing composition according to claim 1, wherein said $C_1$ to $C_4$ ester of lactic acid is derived from a $C_1$ to $C_4$ alcohol selected from the group consisting of methanol, ethanol, propanol, isopropanol, allyl alcohol, butanol, 3-buten-1-ol, t-butanol and sec-butanol and mixtures thereof.

3. A contaminant solubilizing composition according to claim 1, wherein said $C_1$ to $C_4$ ester of lactic acid is ethyl lactate.

4. A contaminant solubilizing composition according to claim 1, wherein said $C_1$ to $C_4$ ester of lactic acid is present in an amount ranging from about 20 to about 60 weight percent.

5. A contaminant solubilizing composition according to claim 1, wherein said surfactant is selected from the group consisting of isotridecyl alcohol tri-ethoxylate, polyethylene glycol ether of mixed synthetic $C_9$–$C_{11}$ fatty alcohols having an average of about 6 moles of ethoxylate, polyethylene glycol ether of mixed synthetic $C_{11}$–$C_{15}$ fatty alcohols having an average of 59 moles of ethoxylate, polyethylene glycol (6) nonylphenyl ether, polyethylene glycol (9) nonylphenyl ether, modified alkanolamine, alkanolamine, phenol alkoxylates and mixtures thereof.

6. A containment solubilizing composition according to claim 1, wherein said surfactant is derived from at least one $C_{10}$ to $C_{16}$ ethoxylated alcohol.

7. A contaminant solubilizing composition according to claim 1, wherein said surfactant is derived from a $C_{12}$ ethoxylated alcohol.

8. A contaminant solubilizing composition according to claim 1, wherein said surfactant is present in an amount ranging from about 10 to about 20 weight percent.

9. A contaminant solubilizing composition according to claim 1, wherein said solvent is water.

10. A contaminant solubilizing composition according to claim 1, wherein said solvent is present in an amount ranging from about 10 to about 50 weight percent.

11. A contaminant solubilizing composition according to claim 1, wherein said oil scavenger is a phosphated ethoxylate blend.

12. A contaminant solubilizing composition according to claim 1, wherein said phosphated ethoxylate blend is a blend of phosphated phenol ethoxylate and phosphated castor oil ethoxylate.

13. A contaminant solubilizing composition according to claim 1, wherein said phosphated ethoxylate blend comprises a blend of about 20 parts phosphated phenol ethoxylate to about 80 parts phosphated castor oil ethoxylate.

14. A contaminant solubilizing composition according to claim 1, wherein said oil scavenger is present in an amount ranging from about 10 to about 20 weight percent, based on the weight of the contaminant solubilizing composition.

15. A contaminant solubilizing composition according to claim 1, wherein said $C_1$ to $C_4$ ester of lactic acid is ethyl lactate;

said surfactant is $C_{10}$ to $C_{16}$ ethoxylated alcohol;

said oil scavenger is a blend of phosphated phenol ethoxylate and phosphated castor oil ethoxylate; and said solvent is water.

16. A contaminant solubilizing composition according to claim 1, comprising:

(a) about 42 weight percent $C_1$ to $C_4$ ester of lactic acid;

(b) about 15 weight percent surfactant;

(c) about 15 weight percent oil scavenger, and (d) about 28 weight percent solvent.

17. A contaminant solubilizing composition; comprising (a) about 1 to about 90 weight percent based on the weight of the contaminant solubilizing composition, of at least one $C_1$ to $C_4$ ester of lactic acid;

(b) about 1 to about 30 weight percent, based on the weight of the contaminant solubilizing composition, of at least one surfactant; and (c) up to about 97 weight percent, based on the weight of the contaminant solubilizing composition, of at least one solvent; and (d) about 1 to about 30 weight percent, based on the weight of the contaminant solubilizing composition, of at least one oil scavenger that is a blend of phosphated phenol ethoxylate and phosphated castor oil ethoxylate.

18. A contaminant solubilizing composition according claim 17, wherein said $C_1$ to $C_4$ ester of lactic acid is ethyl lactate.

19. A contaminant solubilizing composition according to claim 17, wherein said surfactant is derived from at least one $C_{10}$ to $C_{16}$ ethoxylated alcohol.

20. A contaminant solubilizing composition according to claim 17, wherein said solvent is water.

21. A contaminate solubilizing composition according to claim 17, wherein said $C_1$ to $C_4$ ester of lactic acid is ethyl lactate;

said surfactant is a $C_{10}$ to $C_{16}$ ethoxylated alcohol; and said solvent is water.

* * * * *

UNITED STATES PATENT AND TRADEMARK OFFICE

CERTIFICATE OF CORRECTION

PATENT NO. : 6,844,307 B1
DATED : January 18, 2005
INVENTOR(S) : Sumner

It is certified that error appears in the above-identified patent and that said Letters Patent is hereby corrected as shown below:

Column 14,
Line 15, "claim 1" should read -- claim 15 --.

Signed and Sealed this

Twelfth Day of April, 2005

JON W. DUDAS
*Director of the United States Patent and Trademark Office*